US005101527A

United States Patent [19]

Wadsworth, III et al.

[11] Patent Number: 5,101,527

[45] Date of Patent: Apr. 7, 1992

[54] MODULAR BODY SUPPORT SYSTEM

[75] Inventors: Ralph A. Wadsworth, III, Whittier; John E. Rogers, Lake Arrowhead, both of Calif.

[73] Assignee: Convo Corporation, Calif.

[21] Appl. No.: 604,527

[22] Filed: Oct. 29, 1990

[51] Int. Cl.[5] ..... A47C 27/14

[52] U.S. Cl. ..... 5/464; 5/481; 5/496

[58] Field of Search ..... 5/464, 481, 470, 471, 5/465, 468, 473, 474, 496, 497

[56] References Cited

U.S. PATENT DOCUMENTS

| | | | |
|---|---|---|---|
| 3,146,469 | 9/1973 | Slade | 5/91 |
| 3,197,357 | 7/1965 | Schulpen | 161/116 |
| 3,742,528 | 7/1973 | Munch | 5/91 |
| 3,828,378 | 8/1974 | Flam | 5/345 R |
| 3,846,857 | 11/1974 | Weinstock | 5/464 |
| 3,893,198 | 7/1975 | Blair | 5/345 R |
| 4,110,881 | 9/1978 | Thompson | 29/91.1 |
| 4,580,301 | 4/1986 | Ludman et al. | 5/464 |
| 4,628,557 | 12/1986 | Murphy | 5/446 |
| 4,706,313 | 11/1987 | Murphy | 5/464 |
| 4,862,538 | 9/1989 | Spann et al. | 5/464 |
| 4,866,800 | 9/1989 | Bedford | 5/468 |
| 4,901,387 | 2/1990 | Luke | 5/464 |
| 4,903,359 | 2/1990 | Rogers | 5/464 |
| 4,947,500 | 8/1990 | Seiler | 5/464 |

FOREIGN PATENT DOCUMENTS

| | | | |
|---|---|---|---|
| 11755 | 6/1980 | European Pat. Off. | 5/464 |
| 1518845 | 7/1978 | United Kingdom | 5/464 |
| 8102384 | 9/1981 | World Int. Prop. O. | 5/464 |

*Primary Examiner*—Eric K. Nicholson

*Attorney, Agent, or Firm*—Harlan P. Huebner

[57] ABSTRACT

A modular body support system for a prone, supine or side lying person having a plurality of individual functional portions for reacting with body tissues to establish comfort to the person as well as lessen the chances of tissue breakdown and ulcerations. The functional portions having construction such as to prevent shear loading which may cause such tissue breakdown. In addition, the system includes an oversize cover of material to reduce the coefficient of friction and conform easily to the contours of the system as defined by body pressures thereon.

20 Claims, 4 Drawing Sheets

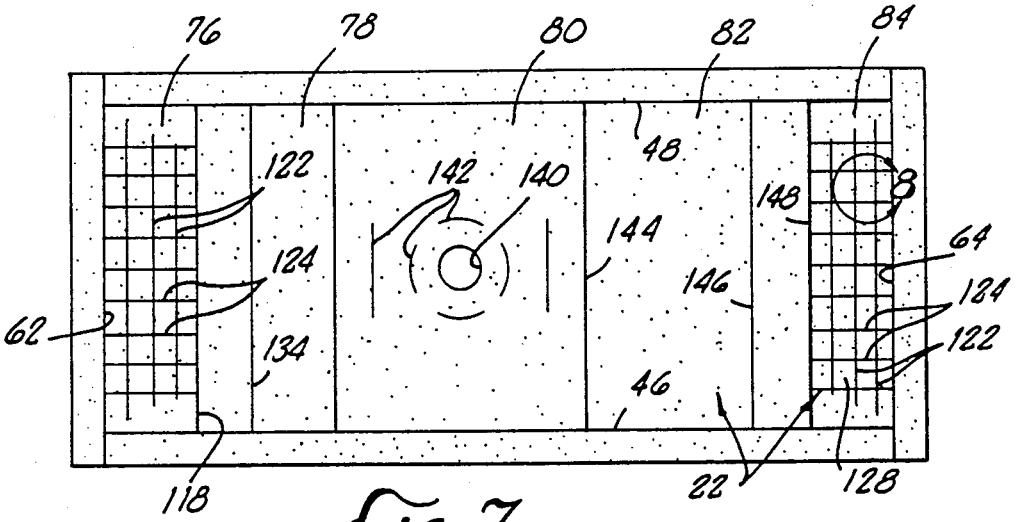
FIG. 7.
FIG. 8.
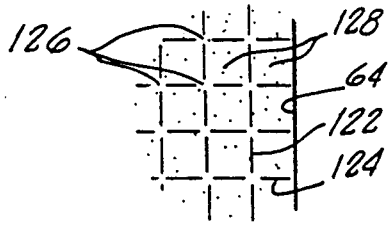
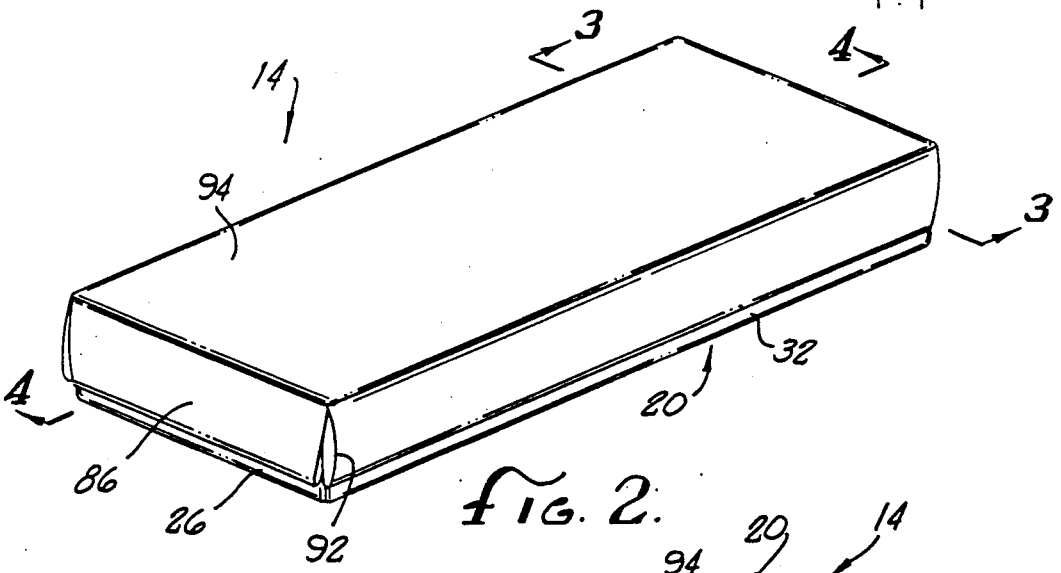
FIG. 2.
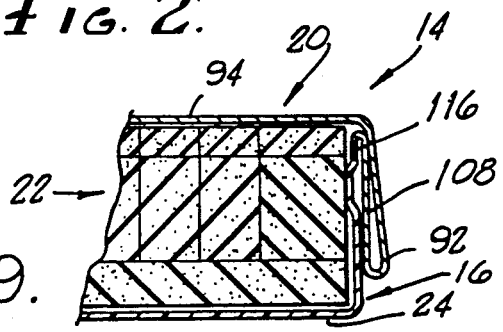
FIG. 9.

MODULAR BODY SUPPORT SYSTEM

BACKGROUND OF THE INVENTION

1. Field of the Invention

This invention relates to a modular body support system for a prone, supine or sidelying person utilizing a support which may be in the form of an elongated frame with independently acting inserts and having an optional oversized cover for use thereon. The system is specifically suited for bed confined patients to prevent tissue trauma.

2. Description of the Prior Art

When a patient in a hospital or convalescent home is required to lay in bed for long periods of time various ways have been devised in an endeavor to find comfort for the person and also to prevent tissue trauma. Tissue trauma may be in the form of decubitus ulcers, ischemic ulcers, bedsores, etc.

Heretofore, mattress designers endeavored to help the patient by constructing a mattress with springs of different compression strength while others have included foam coverings, or overlays endeavoring to reduce discomfort. These developments have not been successful because they do not negate large concentrated loads and when a sufficiently large external force of a support surface is applied against the skin of a patient the skin's supporting infra structure will unsuccessfully attempt to infuse the contracted skin area with blood. If the blood supply is constrained by forces bearing on the vessels or capillaries for any appreciable time, tissue will weaken die and tissue trauma results.

Additional efforts have been made to design overlays and mattresses by utilizing urethane foam of differing density and thickness dependent upon what part of the body will rest thereon. The disadvantage of such structure is that with a solid piece of foam, body weight causing indentation such as a hip bone, etc. will roll the foam into a depression or indentation causing stretching thereof and unwanted friction and pressure contact with the skin area.

In U.S. Pat. No. 3,197,357 issued to K. H. N. Schulper the inventor discloses a mat, pad or mattress formed of convoluted foam. This structure has assisted to some extent in allowing air to pass beneath a body laying thereon. However, as with the previous described construction the convolutions were not completely successful because again the surface do not adequately distribute large concentrated loads.

To some extent this stretching has been overcome by Murphy U.S. Pat. No. 4,706,313. Here the inventor provides cutouts in a block of foam that do not go through the structure but stop before the bottom surface thereof. The cutouts are preferably filled with foam or the foam may be let out creating a void for various parts of the human body. In addition, the patent calls for a bloused oversheet or cover which encases the entire structure. Such a construction creates an undue amount of time to change the cover. The block must be lifted up and the cover unzipped and slide off from around the block. Further the cover consists of a foam sheet and a top sheet. The foam sheet is recited as being preferably one inch in thickness. Such structure would create a hammock effect suspended over the openings which is not desired. Further, with the foam sheet contacting the foam mattress or inserts an extremely high coefficient of friction is created which is not desired. Finally, there is the disadvantage of the cutouts being large and the inserts also being large to fit within the cut outs. Such large pieces of foam do not furnish the desired compression relief for the various parts of the body.

Applicant's are also aware of the patent to Blair, U.S. Pat. No. 3,893,198. This patent is directed to a support structure having individual load bearing foam sections as well as a taut cover. Such a cover defeats the purpose of the individual load bearing units and creates an ordinary solid support fraught with the earlier prior art problems.

SUMMARY OF THE PRESENT INVENTION

It is the purpose of the present invention to provide a modular body support system that includes a foam support frame with foam inserts within the frame to provide an optimal body support configuration regardless of where it is used. Some of the inserts include columnar foot and head members that are separate yet are maintained yieldable as a unit by an upper laminate cut in such a manner to form tying webs between said columns.

Another object of the present invention is to provide a modular body support system that include foam inserts that have slits through at least a part of the insert as well as at least one vertical cavity passing therethrough.

A further object of the present invention is to provide a modular body support system that includes a foam base support frame with foam inserts wherein there is an oversized cover overlying the base and inserts and it is securable to the sides of said base for expeditious removal and replacement.

A still further object of the present invention is to provide a modular body support system that includes a foot cutout section at one end thereof.

Another object of the present invention is to provide a modular body support system of a foam base and foam inserts with a cover thereover wherein there is no "cookie cutter" effect when a body rests thereon. That is, there is no edge cutting into tissue.

A further object of the present invention is to provide a modular body support system to enhance the comfort and reduce tissue trauma of a body resting thereon regardless of its undersupporting structure.

A yet further object of the present invention is to provide a modular body support system that includes a foam base support frame with foam inserts within the frame wherein the base and inserts and the respective inserts may be of different foam density one to the other dependant upon the needs of a body to recline thereon.

Another object of the present invention is to provide a modular body support system which is relatively inexpensive to manufacture and has high performance so that the only new cost involved would generally relate to the replacement of an oversized cover thereon or the individual insert elements.

A further object of the present invention is to provide a modular body support system that provides many different independent functional sections and is light weight and ideal for hospital use.

A yet further object of the present invention is to provide a modular body support system with an oversize cover for foam base support frame with foam inserts therein which is of a different material whereby the coefficient of friction is reduced and the cover will move with a body resting thereon to prevent "hammocking" and tautness which would increase skin trauma.

Another object of the present invention is to provide a modular body support system which may be used independently or may be used as an overlay to be placed upon a mattress.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which:

FIG. 2 is a perspective view of the present invention illustrating the positioning of an oversize cover thereover;

FIG. 7 is a top plan view of the present invention without the oversized cover thereon;

FIG. 8 is an enlarged detailed view of the surface cuts in a foam overlay wherein webs are created taken on the circular line 8 of FIG. 7;

FIG. 9 is an enlarged cross-sectional view of an alternate securement means of the oversize cover to a foam base support frame;

DETAILED DESCRIPTION OF THE PREFERRED EMBODIMENT

Figure 1:
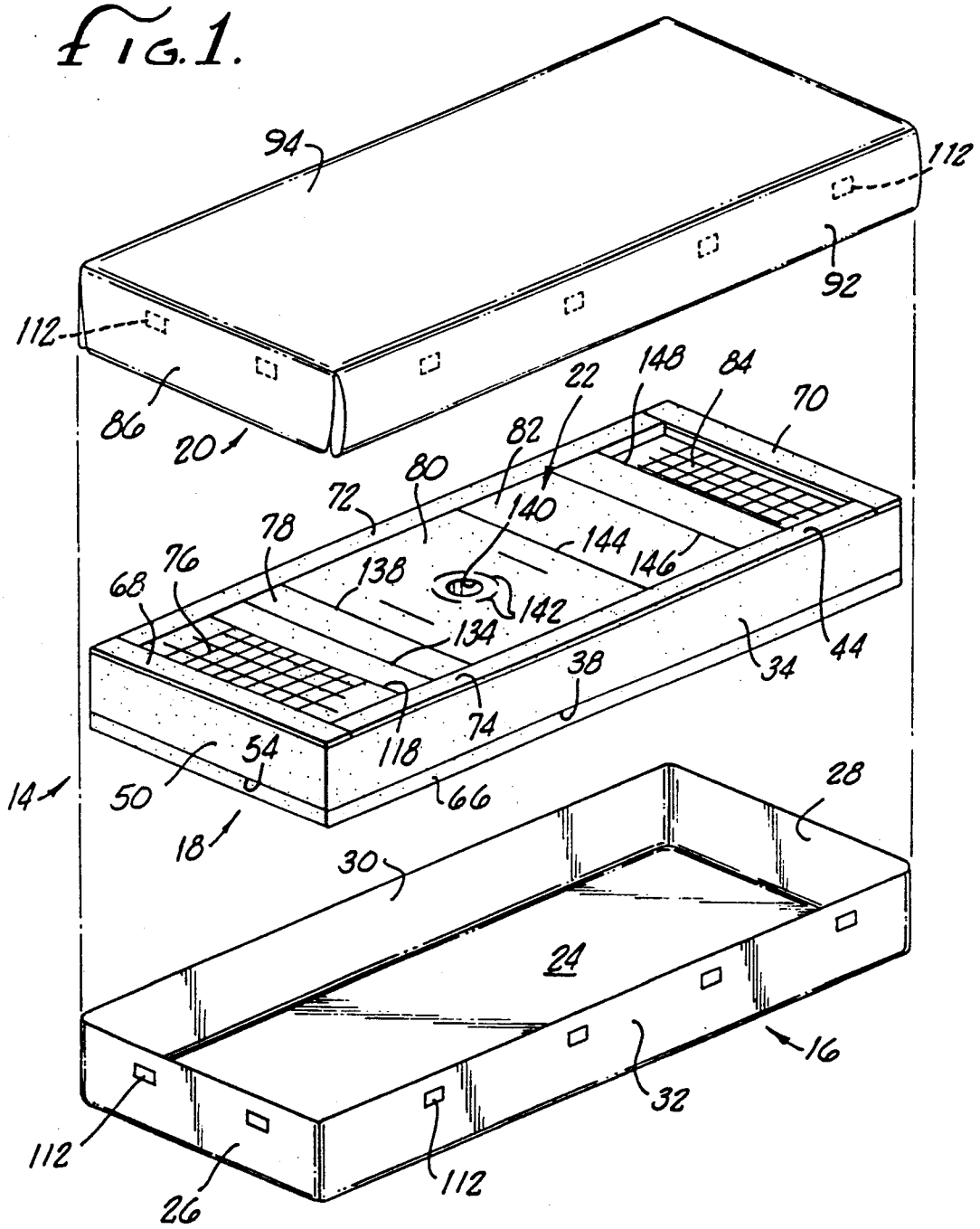
FIG. 1 an exploded perspective view of the present invention.

There is illustrated in the drawings a modular body support system generally designed 14. The system 14 is preferably made up of a base or bottom cover designated 16, a foam base support frame generally designated 18 and usually an oversized top cover generally designated 20 which is adapted to overlie said base support frame 18 and be secured to said base cover 16.

Fitted within the base support frame 18 are a plurality of foam insert members designated 22.

While not shown there may also be employed a second oversized disposable cover that is releasably secured to the oversize cover 20 which may be easily removed after a patient has finished with the system 14 so the system may be readied for another patient by replacing the second cover.

The base or bottom cover 16 is preferably made of sheeting material that is liquid impermeable and flexible. In addition, the cover may be easily cleaned and should be flame retardant, such a product maybe high quality Denier nylon.

The cover 16 includes a bottom 24, vertical end walls 26 and 28 and a pair of vertical elongated side walls 30 and 32. The respective parts form a box or frame to receive the foam base support frame 18. The width and length dimensions of the cover 16 are such as to fit upon a bed such as a hospital bed.

The foam base support frame 18 preferably includes a pair of elongated vertical side members 34 and 36 (see FIGS. 1 and 3) having bottom edges 38 and 40, top edges 42 and 44 and interior vertical walls 46 and 48. Extending between the vertical side member 34 and 36 are a pair of vertical head and foot vertical members 50 and 52 respectively. The walls 50 and 52 each have bottom edges 54 and 56, top edges 58 and 60 and interior vertical walls 62 and 64.

Secured to the bottom edges 38, 40, 58 and 60 of the members 34, 36, 50 and 52 is a bottom foam pad 66 which closes the bottom of the members to finish the frame.

In addition, the top edges 42, 44, 54 and 56 of members 34, 36, 50 and 52 preferably are capped with top finish foam strips 68, 70, 72 and 74. The width of the strips corresponds with the width of the members 34, 36, 50 and 52.

Thus, when the foam base support frame 18 is completed it is adapted to snugly interfit within the vertical walls 26, 28, 30, 32 of the base cover 16 for use.

As can be seen when the members 34, 36, 50 and 52 are assembled and the bottom foam pad 66 is positioned there is created an elongated pocket therein to receive the foam insert members 22.

Generally speaking there are blocks of foam inserts 22 such as head insert 76, shoulder insert 78, main body insert 80, leg insert 82 and foot insert 84. The inserts preferably are elongated extending across the frame between side walls 46 and 48. The inserts rest on bottom foam pad 66 and are removable and replaceable with foam inserts of different density dependent upon the weight of the body to utilize the system 14.

For a covering to overlie the frame 18 in the form of the oversize cover 20, the cover 20 will hang down over the sides 26, 28, 30 and 32 of the base cover, as best seen in FIGS. 3-6. The over hangs 86, 88, 90 and 92 extend down from the body 94 that covers the top of the frame.

At the bottom 96, 98, 100, 102 of the over hangs the cover is folded upwardly forming inner extensions 104, 106, 108, 110 of the overhangs. The inner extensions 104-110 as can be seen are folded upwardly terminating near the top of the frame.

The oversized cover 20 is preferably secured to the base cover 16 by any convenient means such as Velcro fasteners 112.

As can be seen with the construction of the oversize cover 20 it will loosely rest on the support frame 18 and will move with a body 14 as it moves around on the inserts 22 within the frame 18. Such looseness will allow for the cover 20 to conform to the body 114 and prevent a "hammocking" effect where there are openings or spaces below the body 114 to be subsequently explained.

The cover, as previously discussed, is of a flame retardant, fluid proof, anti-static flexible material such as Denier nylon. With the fasteners 112 it is easy to remove and clean or replace.

While not illustrated, the invention may include an outer or top cover which is also oversized and usually considered to be a disposal cover. It would also be flexible to mold to the body 114 and the inserts. It usually would be of a thin fluid proof and flame retardant material such as a spun-bonded melt-blown material that breaths and will allow air to flow around the body. The outer cover may be affixed to the inner or oversize cover 20 in a similar manner to the attachment of cover 20 to the base cover 16.

In FIG. 9 there is illustrated an alternate means of gaffixing the cover 20 at inner extensions 104, 106, 108, 110 to the base cover 16. The means illustrated is a conventional zipper 116.

Now turning to the respective insert number 22, as previously described there is illustrated five inserts 76–84 as best seen in FIGS. 1 and 3 through 7. While the discussion will center on the five illustrated inserts it should be appreciated that number may be decreased or increased without departing from the spirit of the invention.

Figure 3:
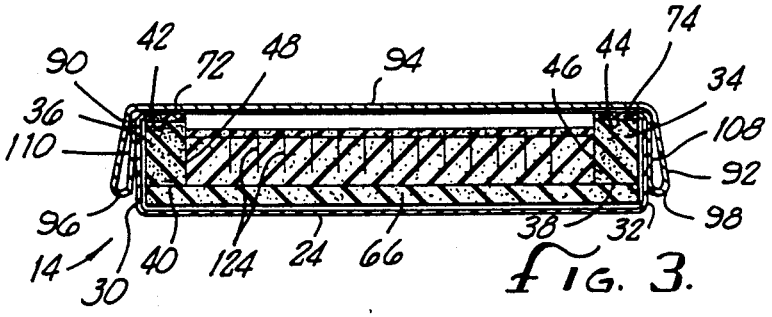
FIG. 3 is a cross-sectional view of the present invention taken on line 3—3 of FIG. 2.
Figure 4:
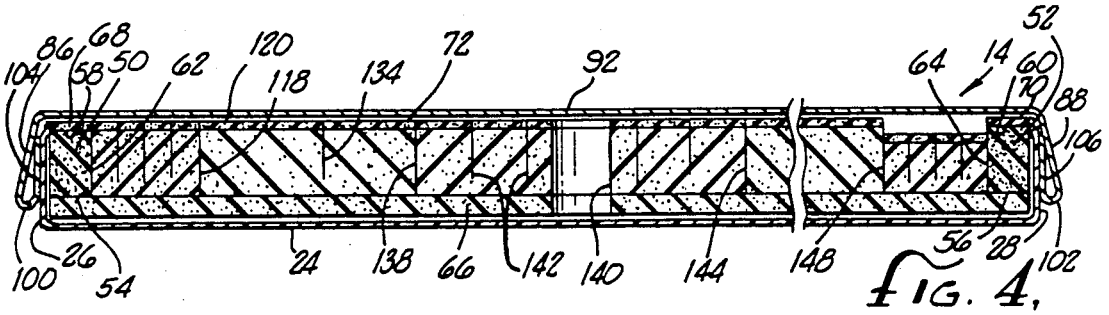
FIG. 4 is a cross-sectional view of the present invention taken on line 4—4 of FIG. 2.

In the illustrations the inserts, save the foot insert 84, raises from the bottom foam pad to the top of the finish foam strips 68–74 as seen in FIGS. 1, 3 and 4. However, should the use of the system 14 be such that fluids from the body 114 are contagious and it is desired to isolate the fluids, then the inserts 76–84 may be cut shorter so that their respective tops lie below the top of the foam strips 68–74. In this way any fluid would be maintained within the frame 18 and its removal in the oversized cover 20 will be facilitated.

Turning now to the inserts 76–84, each of them may be made up of five different foam densities or any combination of densities dependant upon the body 114 to rest thereon. The system 14 is versatile so that the body 114 when placed on the inserts 76–84 can tolerate the weight thereof without compromising tissue viability. The desire is to spread the load over well vascularized non-bony areas.

The head insert 76, as best seen in FIGS. 1 through 6 is a block of foam of a pre-selected density that abuts against the interior vertical wall 62, walls 46 and 48 and has an end wall 118. The insert 76 has a top laminate or foam cover 120 of a soft foam that usually is of a different density than the insert body 76.

The unique construction of the insert 76 will decrease occipital load due to the contouring of the insert which is caused as follows. The insert 76 and the cover 120 are provided with parallel cuts 122 downwardly and across the insert between walls 46 and 48 and cuts 124. The cuts 122 and 124 extend downward but terminate short of the bottom foam pad 66. However, as best seen in FIG. 8, the respective cuts 122 and 124 when approaching intersections of the cuts stop short of continuing across the intersection forming webs 126 between the cuts. These webs 126 extend into the insert 76 for the length of the cuts.

In effect between the intersecting cuts 122 and 124 are united vertical columns 128 of foam. With this construction the head 132 when resting thereon will be contoured by the columns 128 yet because they are united one to another each can adapt to compression dependant upon the facial structure or the deformity of a pillow 130 under the head 132 without complete separation. In this way there is no "cookie cutter" or shear effect which allows the prior art structures that have complete separation from each other to cut into the tissues at the separations.

Instead, with the present development there is no sharp or distinct demarcation or shear of the foam columns due to the uniting webs 126.

The heights of the insert 76 and the others, save the foot insert 84, many be of a height flush with the top of the support frame 18 or may be cut shorter to form a recess below the frame top.

Adjacent to the head insert 76 and butting thereagainst is a shoulder insert 78 interfitted within the frame 18. As seen in the figure there is a shoulder or scapula cut 134 that extends through the laminate or cover 120 to the insert 78, but terminates short of the bottom foam pad 66. In this way the shoulder 136 when resting thereon will separate the cut 134 to achieve greater comfort with interface pressure of the shoulder reduced to acceptable limits.

Butting up against the end 138 of the insert 78 is the main body or sacrum insert 80. This again includes the laminate or foam cover 120 and preferably is of a length to underlie that part of the body 114 from the chest to the upper thighs.

Figure 5:
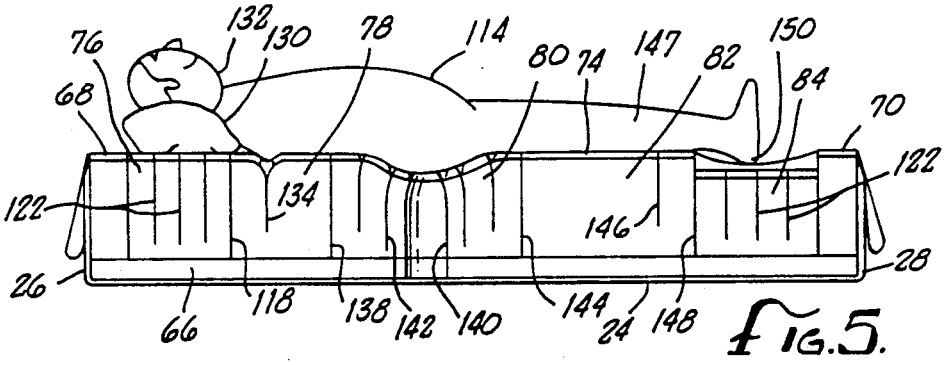
FIGS. 5 and 6 are representations of the present invention with a person thereon in two different positions.
Figure 6:
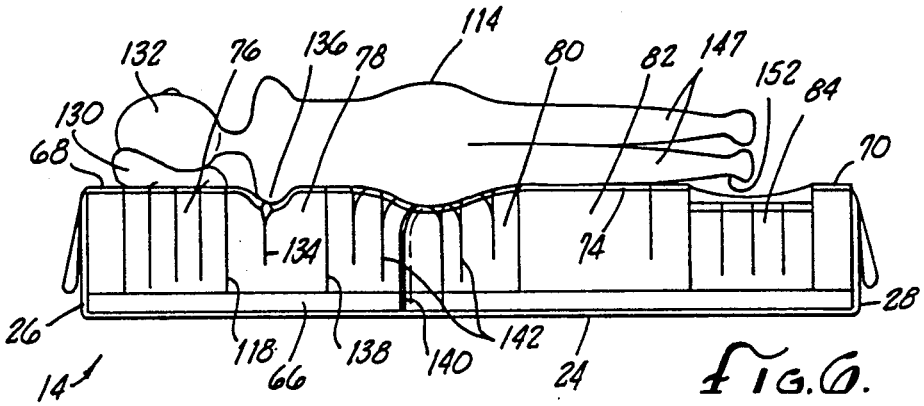

One of the unique characterizations of the main body insert 80 is the provision of a cavity 140 cut through the cover 120, insert 80 and through the bottom foam pad 66. This cavity 140 forms the sacral relief when the body 114 is supine as seen in FIG. 5 and forms the trochanter relief when the body 114 is on its side, as seen in FIG. 6.

Surrounding the cavity 140 are a plurality of relief cuts 142 which again do not extend to the bottom of the insert 80, but stop part way into the insert. Such structure will give the cavity 140 greater flexibility at its edge to reduce shear on tissue.

Thus, as can be seen, in either position the weight of the buttock or hip bone will cause the edge of the cavity 140, which is preferably circular in cross section, to roll inwardly and again contour to the body rather than present a sharp edge to the tissues. This is due to the location of the relief cuts 142.

The leg insert 82 abuts the end 144 of the body insert 80. This insert, it has been found, while still having a foam cover 120 usually only needs to have one cross cut 146 extending from wall 46 to 48. This is due to that fact, the legs 147 represent the flatter parts of the body 114 and thus loads are not concentrated to cause tissue damage.

Finally, in the preferred embodiment there is the foot insert 84 that interfits within the frame 18 and abuts the end 148 of the insert 82. The insert with the laminate or cover 120 is of a lesser height than the other inserts. The height may be such as to afford a slight support of the heels 150 when in the supine position or of the ankles 152 when in the side position, or no support.

When the foot insert 84 is to actually support the foot then it should be cut as previously described with cross cuts 122 and longitudinal cuts 124 with webs 126 between the cuts. Again the vertical columns 128 formed by the cuts allow some freedom of distortion yet are united one with the other so there is a gentle contouring where tissue abuse in prevented.

Thus it can be seen that with the oversize cover 20 draped over the frame 18 and inserts 76–84 there is sufficient play to allow the cover 20 to move with the inserts by body pressure and conform to the cuts and cavity. There will be no bridging or hammocking over open cuts or the cavity 140. The bridging or hammocking negates the concept of pressure and shear relief and encourages decubitus ulcerations.

Figure 10:
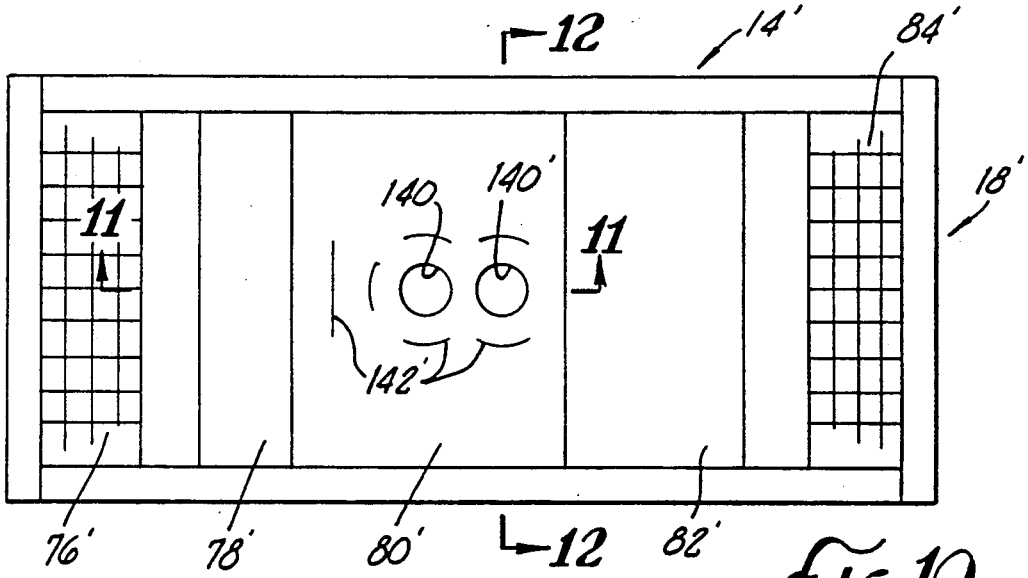
FIG. 10 is a top plane view of a modified structure of the system as illustrated in FIG. 7.
Figure 11:
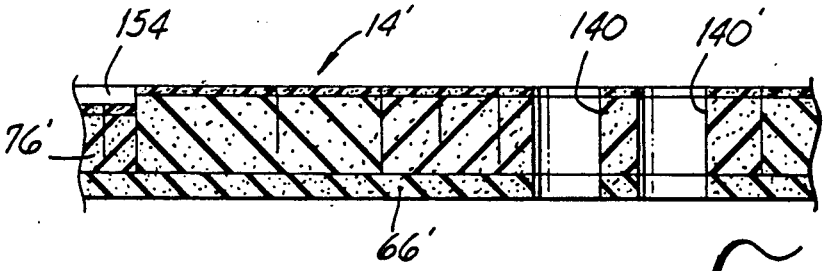
FIG. 11 is a cross-sectional view of the modification of FIG. 10 taken on lines 11—11 of FIG. 10.
Figure 12:
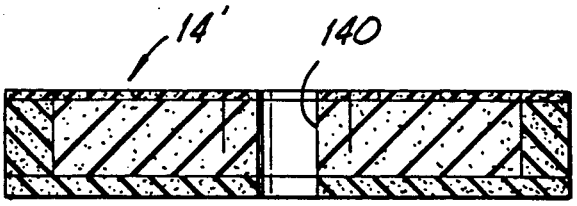
FIG. 12 is a cross-sectional view of the modification of FIG. 10 taken on lines 12—12 of FIG. 10.

In FIGS. 10 through 12 there is illustrated a modified body support system 14' having a support frame 18' and inserts 76', 78', 80', 82' and 84'. The difference resides in the number of cavities 140 formed in the main body insert 80'. Here there are two cavities 140 and 140'. The additional cavity 140' is cut as previously described.

In addition, there are additional relief cuts 142' that surround the respective cavities 140 and 140' to establish the rolling edges so shear is reduced or eliminated.

The additional cavity 140' will help to accommodate anticipated variances in body anatomy. It is also possible to include a third cavity to accommodate variances.

Further, FIG. 11 illustrates another modification where the head insert 76' is of a reduced height and a pillow may be seated in the recess 154 under the head 132.

In the preferred embodiment the foam cover 120 is flush with the tops 68, 70, 72 and 74 of the foam base support frame 18. However, as an alternative structure, best seen in FIG. 3, the foam cover 120 may be lower than the tops 68, 70, 72 and 74 to assure the retention of fluids therein. In this way, spilling is prevented and possible contaminants are isolated.

The invention and its attendant advantages will be understood from the foregoing description and it will be apparent that various changes may be made in the form, construction and arrangements of the parts without departing from the spirit and cope thereof or sacrificing its material advantages, the arrangements herein before describe being merely by way of example. We do not wish to be restricted to the specific forms shown or uses mentioned, except as defined in the accompanying claims, wherein various portions have been separated for clarity of reading and not for emphasis.

We claim:

1. A modular body support system for a prone, supine or sidelying person formed of urethane foam adapted to produce comfort for said person when lying thereon as well as reducing tissue trauma of said person, said system comprising:

a frame including a pair of spaced apart, generally parallel side walls and a pair of spaced apart, generally parallel end walls extending between said side walls, said walls being made of a first density of urethane foam; and a plurality of insert members interfitted within said frame to receive various areas of said person when lying thereon, said insert members being of said first density of urethane foam or differing preselected densities of urethane foam, wherein at least two of said insert members at the end extremities of said frame include a construction different from any insert members intermediate said extremities members; and an oversize cover having a top portion overlying said frame and said insert members and an overhanging portion to extend over said walls with a length and width greater than the height of said walls wherein said length and width greater than said height of said walls is trucked under said overhanging portion and said portion is releasably secured to said walls, and said cover is of such a material as to have a low co-efficient of friction when encountering said frame and said inserts as to move easily with the contour and depression of said insert members when a person lies thereon.

2. A modular body support system as defined in claim 1 wherein:

said frame includes a bottom foam pad underlying said frame which is affixed thereto.

3. A modular body support system as defined in claim 1 wherein:

said frame has a top surface and said insert members each have a top surface, and said insert members top surfaces are spaced below said frame top surface forming a pocket within said frame.

4. A modular body support system as defined in claim 1 wherein there is provided:

a base cover that encompasses the bottom foam pad and the sides of said walls; and said length and width of said oversize cover greater than the height of said walls of said frame are releasably secured to the portion of said base cover that extends up the sides of said walls.

5. A modular body support system as defined in claim 4 wherein:

said base cover is fluid impervious, flame retardant, anti-static, anti-microbial and bacteriostatic.

6. A modular body support system as defined in claim 1 wherein:

each of said inserts includes a top foam cover of a soft low density foam.

7. A modular body support system as defined in claim 6 wherein there is included:

a head insert member extending across said frame between said side walls and abutting one of said end walls, said head insert member including a plurality of parallel cross cuts extending across said insert, and a plurality of parallel opposite cuts extending normal to said parallel cross cuts, said cuts extending through said top foam cover into said member forming vertical quadrilateral columns, each of said cuts stopping short of intersecting a cut normal thereto and forming a vertical web at the corners of said vertical columns extending downwardly and terminating at the terminus of said cuts, whereby said columns each have limited individual compression and contour movements with a head thereon, yet movable as an integrated unit so that said top foam surface will rotate normal to the load applied.

8. A modular body support system as defined in claim 7 wherein there is:

a foot insert member extending across said frame between said side walls and abutting the other of said end walls remote from said head insert member, said foot insert member of a lesser height than said head insert member forming a depression to receive the heels of a person when in a supine position on said system and to receive the ankles of a person when in a sidelying position, said foot insert members including a plurality of parallel cross cuts extending across said insert, and a plurality of parallel opposite cuts extending normal to said parallel cross cuts, said cuts extending through said top foam cover into said member forming vertical quadrilateral columns, each of said cuts stopping short of intersecting a cut normal thereto and forming a vertical web at the corners of said vertical columns extending downwardly and terminating at the terminus of said cuts, whereby said columns each have limited individual compression and contour movements with a foot thereon, yet movable as an integrated unit so that said top foam surface will rotate normal to the load applied.

9. A modular body support system as defined in claim 1 wherein there is included:

a disposable oversize cover adapted to overlie said oversize cover and is releasably secured to said frame and said disposable oversize cover may be fluid proof and flame retardant.

10. A modular body support system as defined in claim 9 wherein:

said disposable oversize cover is of a material differing in thickness from said oversize cover.

11. A modular body support system as defined in claim 2 wherein:

there are three additional insert members between said extremity inserts interfitted within said frame and extending between said side walls, one of said members is a scapula shoulder relief insert, a second of said members is a sacral trochanter relief insert and said third member is a leg relief insert, each of said members including cross cuts extending between said side walls and terminating within said insert, each adapted to spread and roll apart and present a low-shear environment to receive a body extremity resting thereon.

12. A modular body support system as defined in claim 11 wherein said sacral trochanter relief insert includes:

at least one vertical cavity extending completely through said top foam cover, said insert and said bottom foam pad; and a plurality of cuts extending into said insert but not therethrough surrounding said cavity, said cuts offering additional flexibility to the wall of said cavity whereby with a body resting thereon said wall at said top foam cover will roll, reducing shear and injury to said body tissues in the area of said cavity.

13. A modular body support system as defined in claim 12 wherein:

there are a plurality of vertical cavities; and a plurality of cuts surrounding each of said cavities.

14. A modular body support system for a person in a horizontal lying position, said system being adapted to relieve tissue trauma and said system includes a urethane foam frame member having elongated parallel spaced apart side walls and a pair of parallel spaced apart end walls therebetween, the improvement comprising:

a plurality of foam body support insert members secured within said frame and each having characteristics to react independently of each other when engaged by protruding parts of said person lying thereon, yet each insert constructed to reduce tissue trauma, two of said inserts being extremity inserts and each having generally the same cut configurations; and at least one oversize cover portion overlying said frame and insert members and an overhanging portion to extend over said walls with a length and width greater than the height of said walls wherein said length and width are greater than said height of said walls and is tucked under said overhanging portion and is releasably secured to said walls, and said cover is of such a material as to have a low co-efficient of friction when encountering said frame and said inserts as to move easily with the contour and depressions of said insert members when said person lies thereon.

15. A system as defined in claim 14 wherein said two extremity inserts are:

a head insert member and a foot insert member each having a plurality of parallel cross cuts extending across said insert, and a plurality of parallel opposite cuts extending normal to said parallel cross cuts, said cuts extending into said insert but not entirely therethrough forming vertical quadrilateral columns and each of said cuts stopping short of intersecting a cut normal thereto and forming a vertical web at the corners of said vertical columns extending downwardly and terminating at the terminus of said cuts, whereby said columns each have limited individual compression and contour movements with said head and feet thereon, yet movable as an integrated unit so that no individual cut will cause tissue trauma; and said foot insert is of a height in said frame less than the height of said head insert member.

16. A system as defined in claim 14 wherein there is included:

a disposable oversize cover adapted to overlie said oversize cover and is releasably secured to said frame and said disposable oversize cover is fluid proof and flame retardant.

17. In a system as defined in claim 16 wherein:

said disposable oversize cover is of a material thinner than said oversize cover.

18. A system as defined in claim 15 wherein:

there are three additional insert members between said extremity inserts interfitted within same frame and extending between said side walls, one of said members is a scapula shoulder relief insert, a second of said members is a sacral trochanter relief insert and said third member is a leg relief insert, each of said additional members including cross cuts extending between said side walls and terminating within said insert, and each is adapted to spread and roll apart and present a low-shear environment to receive a body extremity resting thereon.

19. A system as defined in claim 18 wherein said sacral trochanter relief insert includes:

at least one vertical cavity extending completely through said insert; and a plurality of cuts extending into said insert but not therethrough surrounding said cavity, said cuts offering additional flexibility to the wall of said cavity whereby with a body resting thereon said wall at said top cover wall will roll eliminating shear and injury to body tissues in the area of said cavity.

20. A system as defined in claim 14 wherein said frame has a top surface and said plurality of insert members each have generally co-planar top surfaces, and said co-planar top surfaces of said insert member are spaced below said frame top surface forming a pocket within said frame.

* * * * *